US005706688A

United States Patent [19]

Dorricott

[11] Patent Number: 5,706,688

[45] Date of Patent: Jan. 13, 1998

[54] PLANT CAPACITY OPTIMIZING METHOD FOR USE WITH STECKEL MILL

[75] Inventor: Jonathan Dorricott, Davenport, Iowa

[73] Assignee: IPSCO Enterprises Inc., Wilmington, Del.

[21] Appl. No.: 481,614

[22] Filed: Jun. 7, 1995

[51] Int. Cl.[6] ..... B21B 1/32

[52] U.S. Cl. ..... 72/203; 72/229; 72/365.2

[58] Field of Search ..... 72/203, 161, 164, 72/229, 199, 365.2, 366.2

[56] References Cited

U.S. PATENT DOCUMENTS

| | | | |
|---|---|---|---|
| 4,658,363 | 4/1987 | Tippins et al. . | |
| 4,745,556 | 5/1988 | Turley | 72/229 |
| 4,881,392 | 11/1989 | Thompson et al. | 72/10.5 |
| 5,499,523 | 3/1996 | Ginzburg | 72/229 |

*Primary Examiner*—Lowell A. Larson
*Assistant Examiner*—Thomas C. Schoeffler
*Attorney, Agent, or Firm*—Robert H. Barrigar; Barrigar & Moss

[57] ABSTRACT

An optimizing method for improving the efficiency of production is provided for a steel rolling mill using a Steckel mill to roll steel slab to end-product thickness, and associated downstream equipment of limited capacity to generate strip and/or plate end-product. The optimizing method allows for continuous processing of steel slab of a mass within the capacity limits of the Steckel mill and equipment upstream of the Steckel mill, but in excess of the capacity of the associated downstream equipment, by first rolling the slab in the Steckel mill to intermediate coilable thickness, and then severing the intermediate steel product to produce two derivative segments, one of a target mass within the limit of capacity of the coiler furnaces and downstream equipment, and another, typically smaller, residual segment. The residual segment is disposed of, optionally first milled to end-product thickness in the Steckel mill, and transferred to conventional downstream equipment. In the meantime, the target segment is held within a coiler furnace. The target segment is subsequently milled and finished to end-product thickness. The method improves the efficiency of production in a steel rolling mill.

16 Claims, 2 Drawing Sheets

PLANT CAPACITY OPTIMIZING METHOD FOR USE WITH STECKEL MILL

This invention relates to an optimizing method for improving the efficiency of production of a steel rolling mill, particularly one employing a Steckel mill.

BACKGROUND OF THE INVENTION

In a steel mill, every piece of equipment is designed to have a certain flow-through capacity or size limitation. Some of the equipment size limits are dependent upon the external dimensions of the material passing therethrough; others are dependent upon weight or mass of material passing therethrough.

In a rolling mill comprising a series of sequential rolling stands designed to accept the initial slab or cast strand and to process it without interruption until final end-product thickness is reached, it is essential that each downstream item of equipment have an operating capacity that is sufficient to handle the incoming material from upstream. This requirement admits of very little flexibility in the mill operation for any given end-product. On the other hand, if a Steckel mill is used to perform all of the rolling (or perhaps all of the rolling following an initial roughing mill reduction or the like) then selection of different slab weights and lengths is possible. The rolling schedule for a Steckel mill may be subject to considerable variation, and it is not always the same piece of equipment that determines the operating capacity or limit for the rolling mill, as a whole, especially if the mill is designed to produce both plate and strip.

Consider, for example, an in-line Steckel mill configuration in which the Steckel mill is to roll a sequence of slabs fed from a reheat walking beam furnace that is capable of handling slabs of 6" thickness, 120" wide and up to 75' long. Such slabs of maximum dimensions weigh approximately 92 tons. The Steckel mill operates in conjunction with a pair of associated coiler furnaces, each of which has an upper limit on its capacity, usually determined by weight. Suppose that each coiler furnace can handle coiled strip or plate up to 75 tons weight. If strip is the end-product, then the strip has to be coiled in a downcoiler or upcoiler, which itself will have a weight limit for a full coil of strip. Suppose that the weight limit of the downcoiler is 37½ tons.

It can be seen that the result of the foregoing limitations is that if the mill operator is asked to produce plate product, he cannot cope downstream with a single slab of 92 tons and hope to use the coiler furnaces for such slab. So he will, in accordance with conventional practice, elect to cut not a 92-ton slab but rather a 75-ton slab, which will be within the limits of capacity of the coiler furnaces used with the Steckel mill. On the other hand, if the mill operator is required to produce strip product, the cut slab is typically limited to 37½ tons, because that is the upper limit of the downcoiler (or upcoiler) capacity. The result is that the mill is not used in an optimally efficient manner, in that the walking beam furnace and Steckel mill, apart from weight limitations of the coiler furnaces and strip coiler devices (and possibly other mill limitations, such as available length of rolling run-out tables) could work with a 92-ton slab, but, in the case where strip is produced, the mill operator is, in accordance with conventional practice, limited to slabs of 37½ tons, and where plate is produced and the intermediate product is coiled in the coiler furnaces, the operator's slab size limit is 75 tons.

SUMMARY OF THE INVENTION

It is my proposal that in a steel rolling mill using a Steckel mill for rolling a steel slab to end-product thickness, the available capacity of the Steckel mill and any associated equipment, e.g. downcoiler, coiler, furnaces, and reheat furnace, be utilized to a much greater extent, and possibly to a maximum, by casting and processing a maximum-weight slab. For the purposes of this specification, a maximum-weight slab is one that is a maximum or near-maximum size or weight for a given slab width within the capacity of all rolling mill equipment (other than the upstream coiler furnace) upstream of the Steckel mill (reheat furnace and roughing mill, for example) despite the fact that the size or weight of such slab may exceed the capacity of downstream equipment such as a coiler drum in a coiler furnace or a strip end-product coiler such as an upcoiler or downcoiler, by way of example.

In particular, according to a first aspect of my invention relating to the production of steel plate, I process such maximum-weight slab initially by flat-passing same in the Steckel mill without winding the sheet of steel into the coiler furnaces, preferably to reach an intermediate or interim thickness no greater than the maximum thickness of steel that can be coiled on the coiler furnace drums (the coiler furnace thickness limitation) above which coiling within the coiler furnace becomes difficult or impossible. If the intermediate (interim) steel product is within the capacity of the coiler furnaces and downstream equipment (herein referred to as the flow-through capacity), then the need for my invention does not arise. But if the intermediate steel product is too long or too heavy to be accommodated as a single piece of material, I transversely sever the intermediate product in such a way that part of it (preferably to a maximum length or weight within the capacity of the coiler furnaces) may be retained in a coiler furnace for further processing, while the other residual or surplus portion is further processed. Since, for example, a 6" slab weighing 92 tons is heavier than can be accommodated by the assumed load capacity of 75 tons of the coiler drums within the coiler furnaces, I can transversely sever the intermediate (interim) steel product to produce two derivative portions, one a larger derivative portion of maximum weight within the capacity of the coiler furnaces (say 75 tons), which I refer to as the target portion, and the other the residual or surplus smaller derivative portion (of weight, say, 17 tons, if the original cast slab was 92 tons).

In the simplest aspect alternative of the foregoing method, the residual (surplus) portion is not further rolled but is trimmed, levelled, cooled, cut to length and stacked in a series of conventional downstream operations. The coiled target portion may then be paid out of the coiler furnace and either further reduced in the Steckel mill or simply paid out, trimmed, levelled, cooled, cut to length and stacked without further rolling.

The foregoing operation is suitable for processing the original slab into two final plate products; one obtained from the residual smaller derivative portion, and the other from the larger target portion, the latter selected to be of weight equal to the maximum weight that can be handled by the coiler furnaces for the Steckel mill. In that way, I obtain the benefit of the re-heating of the larger intermediate product within the coiler furnaces during the rolling procedure, which facilitates the obtention of preferred metallurgical qualities for the end-product.

According to an alternative aspect of my invention, after severing the original slab once it has reached a sheet of intermediate thickness equal to or smaller than the coiler furnace thickness limitation, I coil the larger of the two severed portions of the original slab (the target portion) inside one of the associated coiler furnaces, so as to maintain the target portion at an acceptable rolling temperature, in the same way as described above. The smaller residual portion is then rolled to an end plate thickness selected to be smaller than that of the thickness of the assevered intermediate product. Once this smaller residual portion is reduced to end-product thickness and sent downstream to be cut to length and transported or stored, the Steckel mill resumes the rolling of the larger target portion that had remained temporarily coiled in the coiler furnace, and reduces it to end-product plate or strip thickness.

The foregoing alternative is possible only if the larger target portion, temporarily stored within one of the coiler furnaces, does not protrude outside the mouth of the coiler furnace to an extent sufficient to cause interference with the smaller residual portion being flat-passed in the Steckel mill. The use of an auxiliary set of pinch rolls within the mouth of the coiler furnace, as proposed in the Smith U.S. patent application Ser. No. 08/301,919 filed Sep. 7, 1994, facilitates the retraction of the intermediate product within the coiler furnace to an extent much greater than was previously possible using a conventional coiler furnace, and consequently the use of such auxiliary pinch rolls may be necessary or highly desirable in order that the foregoing alternative mode of operation be practised to advantage. Obviously, the foregoing procedure cannot be practised if the tongue of steel sheet hanging out of the coiler furnace mouth is in the path of travel of the residual portion of the steel being flat-passed within the Steckel mill.

Note that my eventual objective after processing the residual portion will typically be to further reduce the thickness of the larger derivative target portion by rolling same in the Steckel mill whilst coiling the steel as intermediate coiled product within an associated coiler furnace after each pass through the Steckel mill. There may be some loss of temperature of the coiled intermediate steel product awaiting processing even though the coiler furnace burners are operating. Preferably, the smaller residual derivative portion is rolled fairly quickly so that the larger target portion does not suffer undue heat loss. This suggests that the residual portion is best not further rolled but preferably left at the as-severed thickness, or else rolled to a fairly large flat plate thickness in order to minimize the number of reduction passes required (thereby minimizing processing time). But obviously the mill operator has to be influenced by the order book in selecting what product to produce from the smaller residual derivative portion.

While I have indicated above that the severance of the smaller residual derivative portion from the larger target portion is preferably made once the Steckel mill has rolled the original slab to a thickness sufficiently small that the intermediate product could be coiled in the coiler furnace (subject to weight limitations), nevertheless, it would be conceivably possible, although not preferred, to sever the original slab either at a greater thickness or at a lesser thickness, according to the available equipment in the mill and the mill operator's preference. Generally, it is easier to sever a sheet of smaller thickness rather than a sheet of larger thickness. Preliminary rolling of the original slab in its entirety within the dimensional and other constraints of the mill equipment is generally desirable. Efficient rolling of the sheet is best effected while the sheet is in one piece rather than two. However, this latter desideratum is offset by the desirability of making. Use of the coiler furnaces to maintain the steel at preferred rolling temperature, and also by inevitable space limitations within the steel plant. Consequently, I prefer to sever the steel when the intermediate steel product has reached a near-maximum thickness at which it can be coiled within the coiler furnace, subject to weight limitations.

As described above, I have discussed my invention primarily with the objective of obtaining a final plate product. Note that for a plate product, the plate flow-through capacity is typically determined by the coiler furnace capacity, since no upcoiler or downcoiler is used to offload plate product after rolling. However, according to another aspect of my invention, at least part of the original slab may be intended to be reduced to strip thickness. If the slab is rolled to within the coiler furnace thickness limitation, and the intermediate product is then to be further reduced (at least in part) to strip thickness, then when the steel has reached a thickness not exceeding the coiler furnace thickness limitation, I sever the intermediate product so that I am left with two portions of the steel, one of which has a weight selected to be within the strip flow-through capacity, which is typically appreciably smaller than the plate flow-through capacity, because of the need to upcoil or downcoil the strip after rolling to final product thickness. In other words, the strip flow-through capacity is typically determined by the capacity of downstream strip-processing equipment such as a strip coiler. I call this derivative sheet the target strip portion. The other derivative sheet I call the surplus or residual portion. The surplus portion of the intermediate steel product may be sent immediately downstream to be cut to length, etc. as a flat plate product. Alternatively, if the Smith pinch roll invention of U.S. patent application Ser. No. 08/301,919 is used, the surplus portion may be further flat-passed while the target portion yet to be rolled as strip remains idle within a coiler furnace. The surplus portion (which, unlike the residual derivative portion in the aspect of the invention first discussed above, may, in fact, be as large a piece of material as the target strip portion) is further reduced in thickness to final end-product thickness (conveniently plate, to minimize the time during which the target portion remains idle in the coiler furnace). The procedure is then essentially the same as the procedure described above relative to the first aspect of my invention, except that the target strip portion is rolled into strip by the Steckel mill using the coiler furnaces, and the eventual strip is coiled in an upcoiler or downcoiler and transferred out of the mill for shipment as coiled strip in accordance with conventional practice.

For example, if the downcoiler in a particular mill can handle 96"-wide strip weighing 37.5 tons, then the original slab would weigh approximately 73.5 tons, and the target portion would weigh about 37.5 tons, and the surplus portion about 36 tons.

As a further alternative, one or both severed sheet portions could be made into coiled plate product.

In all of the above aspects of my invention, I have proposed that the target portion of the intermediate product to be further rolled in the Steckel mill with the use of the coiler furnaces remain in idle holding position within a coiler furnace drum, while the other (residual or surplus) portion severed from the original slab is flat-passed to final product thickness.

For the purposes of implementing the foregoing processes, according to my invention, it is advantageous to provide a hot-flying shear just downstream of the Steckel mill so that the required severance of the intermediate product may occur without difficulty. Such downstream hot-flying shears are known, per se, and are referred to, for example, in prior U.S. Pat. No. 4,658,363 (Tippins et al) granted on Apr. 14, 1987.

No mention has been made in the above discussion of the usual equipment in a rolling mill to meet requirements for controlled cooling, descaling, edge control, etc. These are assumed to be present and conventional in character, designed in accordance with conventional design practices.

DETAILED DESCRIPTION WITH REFERENCE TO THE ACCOMPANYING DRAWINGS

Figure 1:
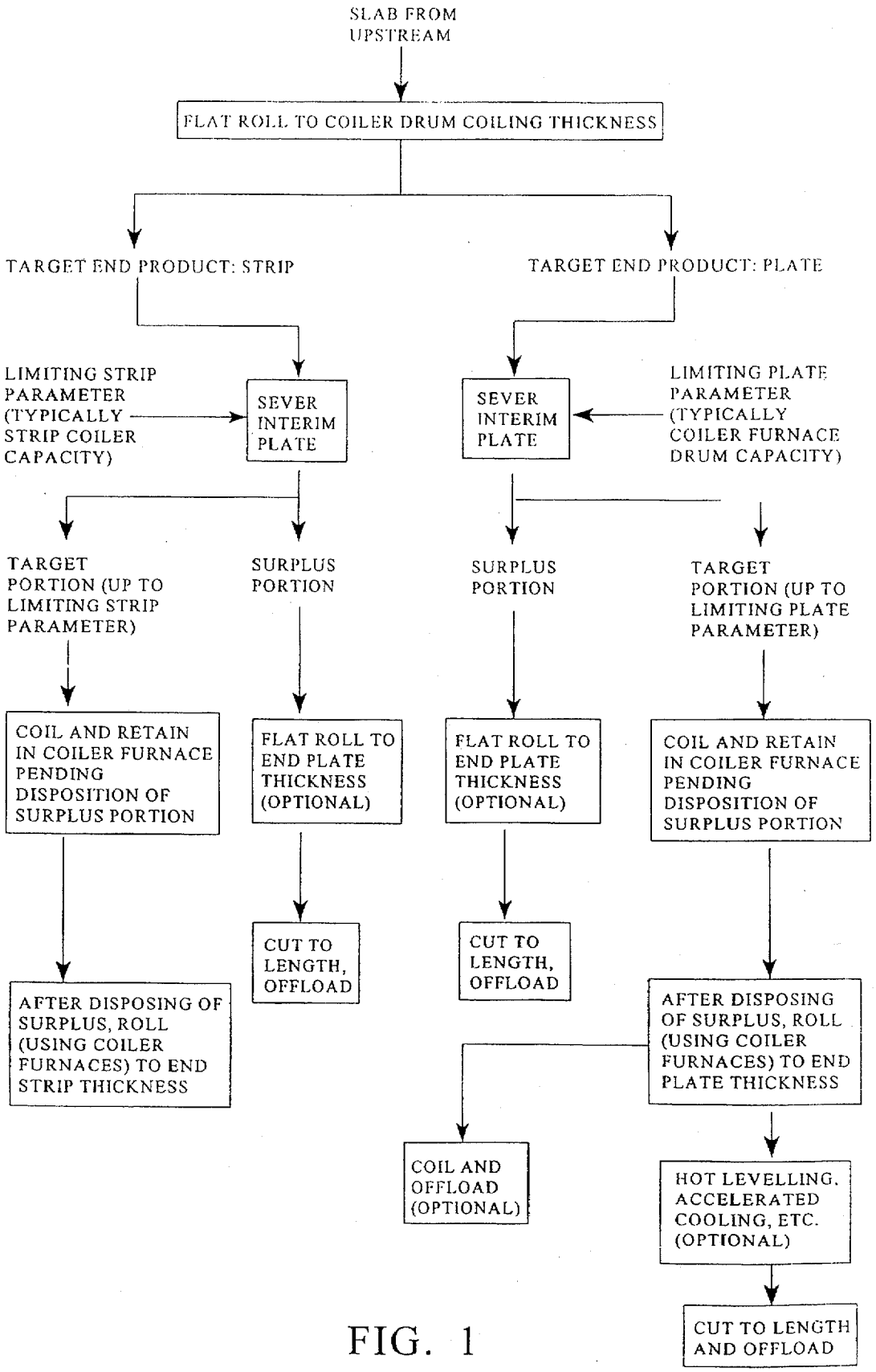
FIG. 1 is a flow chart indicating a preferred sequence of operations for optimizing the efficiency of a rolling mill in accordance with the principles of the present invention.

Referring to FIG. 1, the optimizing procedure to be described and claimed herein is confined to an optimizing procedure for use with a Steckel mill. The term "Steckel mill" means any suitable reversing rolling mill typically used in conjunction with coiler furnaces located immediately upstream and immediately downstream of the Steckel mill. (There will be no reference in this discussion to conventional apparatus commonly used in conjunction with the Steckel mills, such as controllers, descaler boxes, gauges, etc.)

Referring to FIG. 1, a maximum-weight slab from an upstream source (e.g. a walking beam furnace) is rolled by flat-passing in the Steckel mill to produce an interim or intermediate plate product having a thickness no greater than the coiler furnace thickness limitation, i.e. sufficiently small that the steel being rolled can be coiled in the coiler furnaces on either side of the Steckel mill. At that point, the procedure to be followed diverges, depending upon whether the target end-product is strip or the target end-product is plate. If the target end-product is strip, then one proceeds through the left-hand half of the flow chart of FIG. 1, whereas if the target end-product is plate, one proceeds through the right-hand side of the flow chart.

Let us assume for the moment that the target end-product is plate, in which case one must ascertain the limiting parameter governing the production of a plate end-product. Typically this limiting parameter is the weight capacity of the coiler furnace drum. Given the limiting plate parameter, one severs the interim plate, preferably using a hot shear just downstream of the downstream coiler furnace, so that the plate is divided into two portions, namely a target portion and a surplus portion. The target portion is selected to be of a size and weight reaching, within engineering limits, the limiting plate parameter (preferably) or some selected parameter lower than the limiting plate parameter (normally not preferred). The surplus portion is that portion of the interim plate that remains, and is typically significantly smaller than the target portion.

The severed target portion of the interim sheet is coiled and retained in the coiler furnace on the more convenient side of the Steckel mill, pending the disposition of the surplus portion. In the simplest case, the surplus portion is cut to length and offloaded as a finished plate product. Alternatively, the Smith invention of U.S. patent application Ser. No. 08/301,919 or some suitable alternative (e.g. a temporary deflecting or suspending mechanism for the tongue) is used to bring the tongue of the target portion out of the path of travel of the surplus portion as the latter is further flat-passed through the Steckel mill and reduced. In the latter case, the surplus portion is rolled to end-product thickness, while the target portion remains idle, coiled at rolling temperature within a coiler furnace pending the completion of rolling of the surplus portion. After the surplus portion is flat-passed and reduced to a predetermined end plate thickness determined by customer order, it is then cut to order length and off-loaded for stacking, storage or transportation.

Once the flat-pass rolling of the surplus plate portion is completed or the surplus plate simply cut to length and off-loaded, the target portion of the plate, which has been retained within one of the coiler furnaces at or somewhat above preferred rolling temperature, is paid out of the coiler furnace and reduced in thickness by the Steckel mill to end plate thickness. Following optional accelerated cooling, hot levelling, etc., the plate may be cut to length and off-loaded in accordance with conventional practice. Alternatively, if the plate is to be sold as coiled plate, then it may be downcoiled in the strip downcoiler (its capacity permitting) or may bypass the hot leveller and may instead be fed to a suitable plate coiler (upcoiler or downcoiler) and offloaded.

If, on the other hand, the target end-product is strip rather than plate, then one progresses through the left-hand side of the flow chart of FIG. 1. In that event, the limiting strip parameter must be ascertained. Typically, this is the capacity of the strip coiler (upcoiler or downcoiler, as the steel plant designer prefers). When this is determined, the interim steel product at or below the coiler furnace thickness limitation is transversely severed to generate two pieces, one a target portion of selected size and weight up to the limiting strip parameter, and the other, a surplus portion. The target portion is coiled and retained in one of the coiler furnaces adjacent to the Steckel mill, pending completion of the disposition (including, with the aid of the aforementioned Smith pinch roll invention or other suitable expedient, the further flat-pass rolling) of the surplus portion. The surplus portion may constitute an as-severed final plate product, or may be flat-pass rolled to a predetermined end plate thickness. Once this end plate thickness has been reached, the surplus portion is then cut to length and off-loaded.

Once the surplus portion has been disposed of, the interim plate target portion which has been coiled and retained in the coiler furnace and thus remains at or above desired rolling temperature, is paid out of the coiler furnace and is rolled sequentially by means of reversing upstream and downstream passes through the Steckel mill, using the coiler furnaces to coil the interim sheet after each pass if desired, until desired end-product thickness is reached. The strip is then coiled in a suitable strip coiler (upcoiler or downcoiler, as preferred) and off-loaded for transportation or storage.

It can be seen that by following the flow chart of FIG. 1, all normally available possibilities are accommodated. The slab maximum-weight emanating from upstream that is flat-rolled to within the coiler furnace thickness limitation can be of maximum weight and dimensions (for a given end-product width) as determined by the designed characteristics of the steel mill equipment. Typically, the limiting factor upstream of the Steckel mill may be furnace capacity, or it may be instead the rolling length available for flat-pass rolling by the Steckel mill. In any event, the maximum-weight upstream slab may typically be of dimensions and weight greater than can be accommodated by the limiting downstream item of equipment or procedure, whether that be a limitation referable to an end strip product or a limitation referable to an end plate product. Since the designer of the steel mill will typically try to achieve as much harmony and balance as possible between the various physical parameters applicable, it is unlikely that the maximum-weight slab, being flat-pass rolled to within the coiler furnace thickness limitation, is greatly in excess of the limiting parameter downstream, but where the final product is to be strip, it may be that in a given steel mill, the limiting parameter is the capacity of the strip coiler, and it may be that there is a substantial disparity between upstream and downstream equipment capacity. Strip coiler capacity is usually not relatively large, and it is entirely possible that the maximum capacity of the strip coiler, measured by weight, is little more than half or even less than half the weight of the maximum-weight slab that can be produced upstream of the Steckel mill and accommodated in the Steckel mill, for at least larger widths of product material.

Figure 2:
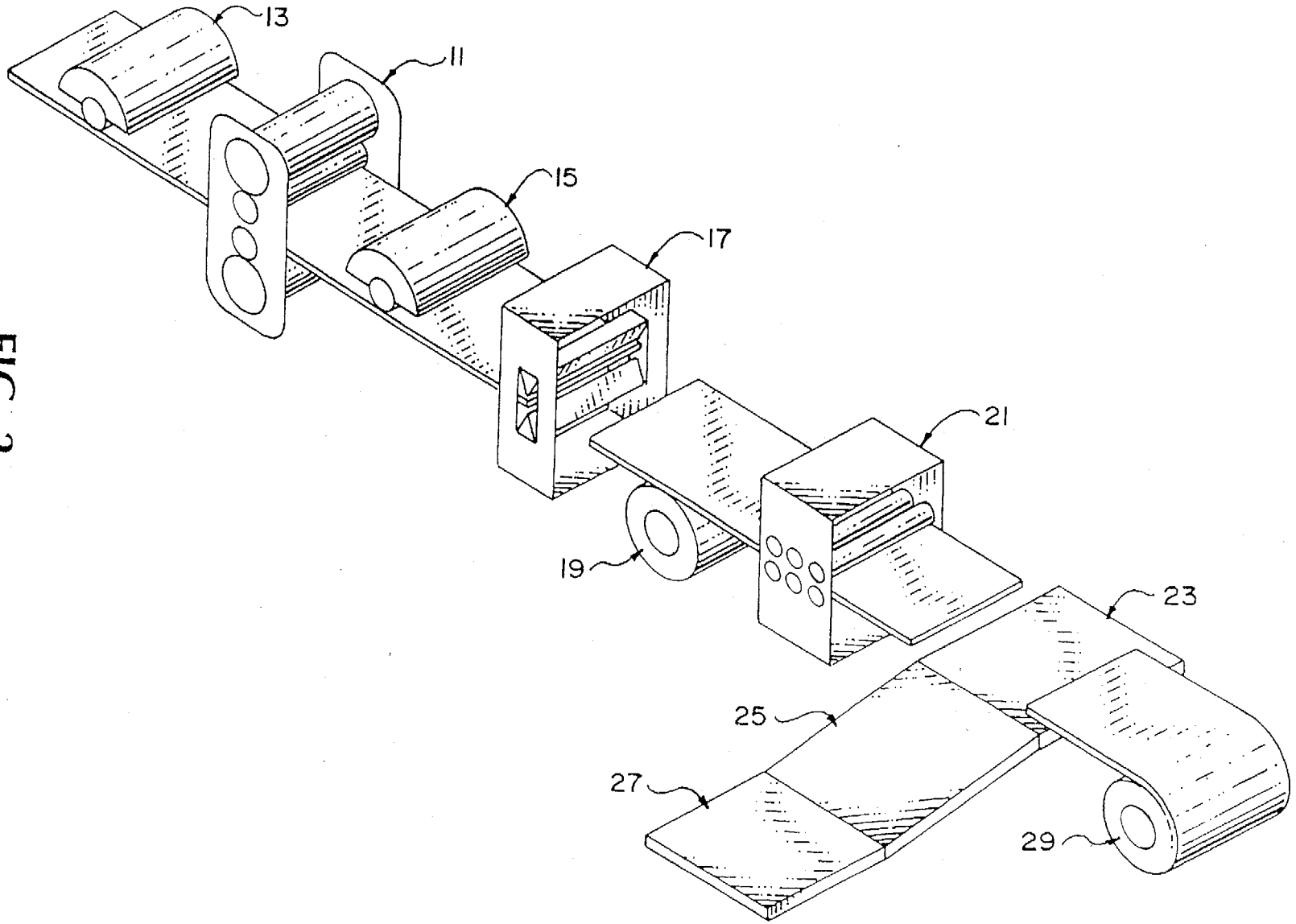
FIG. 2 is a schematic diagram illustrating apparatus suitable for implementation of the optimizing procedure of FIG. 1, according to the present invention. The apparatus, per se, is old; its method of utilization, as described and claimed herein, is considered to be novel.

Apparatus suitable for implementation of the procedure described with reference to FIG. 1 is illustrated in FIG. 2. Each item of equipment illustrated in FIG. 2 is conventional in character. On either side of a Steckel mill 11, are an associated upstream coiler furnace 13 and downstream coiler furnace 15. A hot shear 17 is located just downstream of the downstream coiler furnace 15. Downstream of the hot shear 17 is a strip downcoiler 19 on which strip to be off-loaded is wound; an upcoiler could, of course, be substituted for the downcoiler 19. Downstream of the downcoiler 19 is a hot leveller 21. This hot leveller 21 may be omitted if all of the expected plate product will be coiled plate product and not flat plate product, but is desirably included if flat plate product is being produced, for reasons previously explained with reference to FIG. 1. Downstream of the hot leveller 21 is a transfer station 23 from which flat plate may be transferred to cooling bed 25. From the cooling bed 25, the cutting and off-loading finished plate is cut to length and off-loaded at station 27. Alternatively, as an alternative to flat plate levelling, cutting and off-loading, the final plate may be coiled in a plate downcoiler 29 and then off-loaded for storage or shipment. If all plate to be coiled can be accommodated by the strip coiler 19, then plate downcoiler 29 may be omitted.

The spacing between the units of FIG. 2 is not to scale; there would be much more distance between the hot shear 17 and downcoiler 19, for example, than is illustrated. Further, items of equipment normally provided in rolling mills (e.g. laminar-flow cooling apparatus, edgers, descalers, etc.) are not shown at all, in the interest of simplification. The choice of such other equipment is up to the mill designer.

Alternatives and variants of the above-described methods and of apparatus suitable for practising the methods will occur to those skilled in the technology. The scope of the invention is as defined in the accompanying claims.

What is claimed is:

1. A method of optimizing the production of a steel rolling mill that includes a Steckel mill, the operation of said rolling mill being limited at least in part by at least one flow-through capacity parameter for strip and plate end-products respectively, to perform the rolling of a maximum-weight slab exceeding the flow-through capacity for an end-product of target thickness, the Steckel mill having associated therewith upstream and downstream coiler furnaces capable of coiling plate up to a coiler furnace thickness limitation and downstream equipment for further processing and handling of the steel following its rolling, the weight of the end-products of target thickness being limited by the limiting flow-through capacity parameter; said method comprising the steps of:

(a) flat-pass rolling the maximum-weight slab in the Steckel mill to produce an interim steel product of a thickness not exceeding the coiler furnace thickness limitation;

(b) transversely severing the interim steel product into two portions, viz a pre-determined target portion whose weight and dimensions are at or below the limiting flow-through capacity parameter for the end-product targeted, and a residual surplus portion;

(c) retaining the target portion coiled within a selected one of the coiler furnaces, pending disposition of the surplus portion;

(d) disposing of the surplus portion; and then (e) disposing of the target portion.

2. A method as defined in claim 1, wherein step (b) comprises severing the interim steel product to yield two portions, viz a target portion having a weight or dimensions not exceeding the limiting flow-through capacity parameter for a strip end-product, and a residual surplus portion.

3. A method as defined in claim 2, wherein the limiting flow-through capacity parameter for a strip end-product is the strip coiler capacity.

4. A method as defined in claim 2, wherein step (d) comprises directing the surplus portion downstream for processing as strip end-product.

5. A method as defined in claim 2, wherein step (d) comprises directing the surplus portion downstream for processing as plate end-product.

6. A method as defined in claim 2, wherein step (d) comprises rolling the surplus portion to a strip of pre-determined end-product thickness, then directing the surplus portion downstream for processing as strip end-product.

7. A method as defined in claim 2, wherein step (d) comprises rolling the surplus portion to a plate of pre-determined end-product thickness, then directing the surplus portion downstream for processing as plate end-product.

8. A method as defined in claim 2, wherein step (e) comprises rolling the target portion to a strip of pre-determined end-product thickness, then directing the target portion downstream for processing as strip end-product.

9. A method as defined in claim 1, wherein step (b) comprises severing the interim steel product to yield two portions, a target portion having a weight or dimensions not exceeding the limiting flow-through capacity parameter for a plate end-product, and a residual surplus portion.

10. A method as defined in claim 9, wherein the limiting parameter for a plate end-product is the coiler furnace capacity.

11. A method as defined in claim 9, wherein step (d) comprises directing the surplus portion downstream for processing as strip end-product.

12. A method as defined in claim 9, wherein step (d) comprises directing the surplus portion downstream for processing as plate end-product.

13. A method as defined in claim 9, wherein step (d) comprises rolling the surplus portion to a strip of pre-determined end-product thickness, then directing the surplus portion downstream for processing as strip end-product.

14. A method as defined in claim 9, wherein step (d) comprises rolling the surplus portion to a plate of pre-determined end-product thickness, then directing the surplus portion downstream for processing as plate end-product.

15. A method as defined in claim 9, wherein step (e) comprises rolling the target portion to a plate of pre-determined end-product thickness, then directing the target portion downstream for processing as plate end-product.

16. A method as defined in claim 15, wherein the targeted end-product is flat plate, and wherein step (e) further comprises hot levelling of the target portion following a final reduction pass through the Steckel mill.

* * * * *

UNITED STATES PATENT AND TRADEMARK OFFICE

CERTIFICATE OF CORRECTION

PATENT NO. : 5,706,688

DATED : 13 January 1998

INVENTOR(S) : Jonathan Dorricott

It is certified that error appears in the above-identified patent and that said Letters Patent is hereby corrected as shown below:

Col. 2, line 2, delete the "," appearing before "furnaces";

Col. 3, line 4, change "assevered" to --as-severed--;

Col. 3, line 61, change "of making. Use of the coiler furnaces" to --of making use of the coiler furnaces--;

Col. 6, line 52, change "slab maximum-weight" to --maximum-weight slab--;

Signed and Sealed this

Eighth Day of June, 1999

*Attest:*

Q. TODD DICKINSON

*Attesting Officer*

*Acting Commissioner of Patents and Trademarks*